US005144800A

United States Patent [19]

Shioya et al.

[11] Patent Number: 5,144,800

[45] Date of Patent: Sep. 8, 1992

[54] EXHAUST MANIFOLD SYSTEM FOR A TRANSVERSE V-TYPE ENGINE

[75] Inventors: Yoshiaki Shioya; Toshiro Shimamoto; Susumu Kawamoto; Izumi Arai, all of Kyoto, Japan

[73] Assignee: Mitsubishi Jidosha Kogyo Kabushiki Kaisha, Tokyo, Japan

[21] Appl. No.: 781,726

[22] Filed: Oct. 23, 1991

[30] Foreign Application Priority Data

Oct. 24, 1990 [JP] Japan ..... 2-111238[U]

[51] Int. Cl.[5] ..... F01N 07/10

[52] U.S. Cl. ..... 60/323; 60/299

[58] Field of Search ..... 123/52 MV; 60/302, 320, 60/321, 323, 299

[56] References Cited

U.S. PATENT DOCUMENTS 4,653,270 3/1987 Takii ..... 60/302

4,731,993 3/1988 Ito et al. ..... 60/299

*Primary Examiner*—Ira S. Lazarus

*Assistant Examiner*—L. Heyman

[57] ABSTRACT

An exhaust manifold system is provided for a transverse V-type engine including front and rear banks, each having a plurality of cylinders. The exhaust manifold system includes a front exhaust manifold for conducting the exhaust gas discharged from the cylinders of the front bank to an exhaust pipe, and a rear exhaust manifold for conducting the exhaust gas discharged from the cylinders of the rear bank to the exhaust pipe. This exhaust manifold system may be produced by welding stainless steel pipes for the front exhaust manifold and forming the rear exhaust manifold of cast iron.

4 Claims, 3 Drawing Sheets

EXHAUST MANIFOLD SYSTEM FOR A TRANSVERSE V-TYPE ENGINE

BACKGROUND OF THE INVENTION

1. Field of the Invention

This invention relates to an exhaust manifold system for an automotive transverse V-type engine.

2. Description of the Related Art

Recently, front engine front drive (FF) formula has been widely used in passenger cars with a view to improving roominess, mobility, etc. In such FF type automobiles, an engine is mounted transversely to a vehicle body, i.e., the engine output shaft is oriented in the transverse direction of the vehicle, for structural reasons. In particular, for a multicylinder engine, a V-type engine is used to reduce the engine length, because of the restriction on the space of the engine room, particularly, the vehicle width.

In such transverse V-type engines, an exhaust manifold is provided for each of front and rear banks; the front exhaust manifold for the front bank is mounted to a front portion of the bank, and the rear exhaust manifold for the rear bank is mounted to a rear portion of the bank.

In general, exhaust manifolds for engines are produced by casting metal, or by welding stainless steel pipes, and this is the case with transverse V-type engines. Namely, in conventional transverse V-type engines, exhaust manifolds produced by the same method are used for both the front and rear banks.

When designing the exhaust manifolds for the right and left banks of a longitudinal V-type engine which is mounted to a vehicle body with the engine output shaft oriented in the same direction as the longitudinal direction of the vehicle body, various conditions such as the space, temperature, distance from a catalytic converter for purifying the exhaust gas, do not vary significantly. In the case of the transverse engine, however, since the banks are located in the front and the rear of the engine, respectively, the conditions such as the space, temperature, distance to the catalytic converter greatly vary. For example, the engine is arranged in the engine room as close to the center of the vehicle body as possible, and accordingly, the space for the exhaust manifold of the rear bank is smaller than that for the front exhaust manifold. Further, since the rear exhaust manifold is located at the rear side of the engine, it is only slightly cooled by wind while the vehicle is running, as compared to the front exhaust manifold. Thus, the rear exhaust manifold must be designed such that the exhaust passage therein zigzags, because the rear exhaust manifold is mounted in a small space, and the heatresisting strength is higher than that of the front exhaust manifold, because the rear exhaust manifold is only slightly cooled.

If, however, the front exhaust manifold for the front bank is produced so as to have a heat-resisting strength equal to that of the rear exhaust manifold for the rear bank, then the front exhaust manifold has a higher heat-resisting strength than necessary, which leads to an increase of weight and hence thermal capacity, and increased cost.

Furthermore, although the catalyst should desirably be activated as soon as possible after the start of the engine for the purification of the exhaust gas, the distance of the front exhaust manifold to the catalytic converter is inevitably longer than that of the rear exhaust manifold to the catalytic converter. Therefore, the thermal capacity of the front exhaust manifold is preferably small, so that the exhaust gas from the front bank may not be excessively cooled by the front exhaust manifold.

SUMMARY OF THE INVENTION

An object of this invention is to provide an exhaust manifold system for an automotive transverse V-type engine which has a sufficient heat-resisting strength, is compact to fit in a small engine room, and can activate the catalyst early at the start of the engine to thereby improve the exhaust gas purification rate.

According to this invention, there is provided an exhaust manifold system for a transverse V-type engine in which an engine output shaft extends in the same direction as a transverse direction of an automotive vehicle and which includes front and rear banks, each having a plurality of cylinders, and an exhaust pipe.

The exhaust manifold system according to an embodiment of this invention comprises a front exhaust manifold for conducting an exhaust gas discharged from the cylinders of the front bank to the exhaust pipe, and a rear exhaust manifold for conducting an exhaust gas discharged from the cylinders of the rear bank to the exhaust pipe, wherein the front exhaust manifold is produced by welding stainless steel pipes, and the rear exhaust manifold is produced of cast iron.

Preferably, the pipes for producing the front exhaust manifold are made of stainless steel SUS430LX, a flange at which the front exhaust manifold is attached to the front bank is made of carbon steel, and an outlet flange at one end of the front exhaust manifold close to the exhaust pipe is made of stainless steel SUS410L.

According to the exhaust manifold system for an embodiment of this invention, since the rear exhaust manifold for the rear bank is made of cast iron, the system can be made compact, the engine can be arranged as close to the center of the vehicle as possible, and the length of the engine room can be reduced. The front exhaust manifold for the front bank, on the other hand, is produced by welding stainless steel pipes, whereby the weight and the thermal capacity can be reduced, and the amounts of toxic ingredients in the exhaust gas can be cut down because the weight of the engine and the catalyst activation time at the start of the engine are reduced.

The above and other objects, features, and advantages of this invention will become apparent from the ensuing detailed description taken in conjunction with the accompanying drawings.

DETAILED DESCRIPTION OF THE PREFERRED EMBODIMENTS

Figure 1:
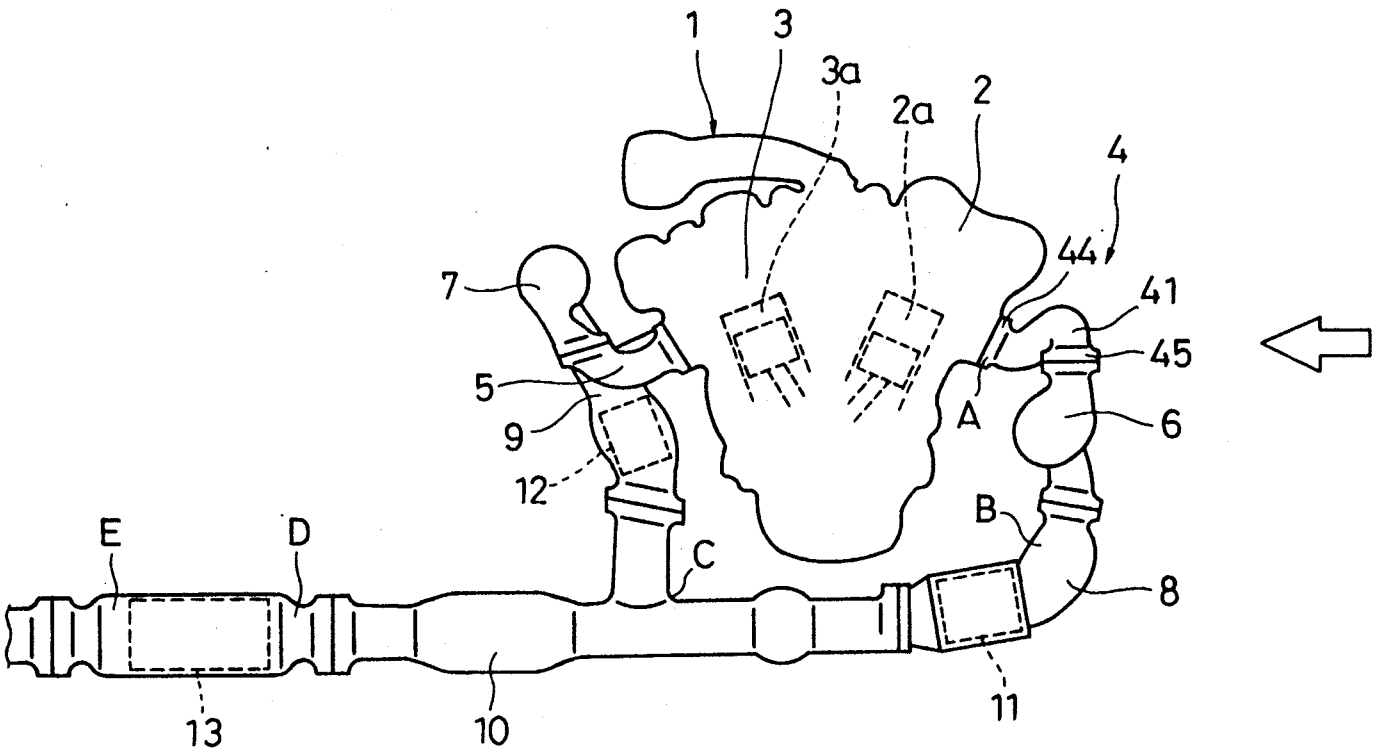
FIG. 1 is a side view of a transverse V-type engine to which an exhaust manifold system according to an embodiment of this invention is applied.

FIG. 1 shows a transverse V-type engine 1 as viewed from the side of a vehicle body. The engine 1 has a front bank 2 and a rear bank 3, in which a plurality of cylinders 2*a* and 3*a* are respectively arranged. A front exhaust manifold 4 and a rear exhaust manifold 5 are mounted to the respective banks, to conduct exhaust gas, discharged from the cylinders, to an exhaust pipe 10, mentioned later. The front exhaust manifold 4 is attached to a front surface of the front bank 2, and is produced by welding stainless steel pipes, as described in detail later. The rear exhaust manifold 4 is attached to a rear surface of the rear bank 3, and is produced by casting. These exhaust manifolds 4 and 5 are connected to exhaust pipes 8 and 9 via turbochargers 6 and 7, respectively, and the exhaust pipes 8 and 9 are connected to the single main exhaust pipe 10. Front catalytic converters 11 and 12 are arranged in the exhaust pipes 8 and 9, respectively, and a main catalytic converter 13 is arranged in the main exhaust pipe 10. In FIG. 1, the arrow indicates the direction of air flowing into the engine room during running.

Figure 2:
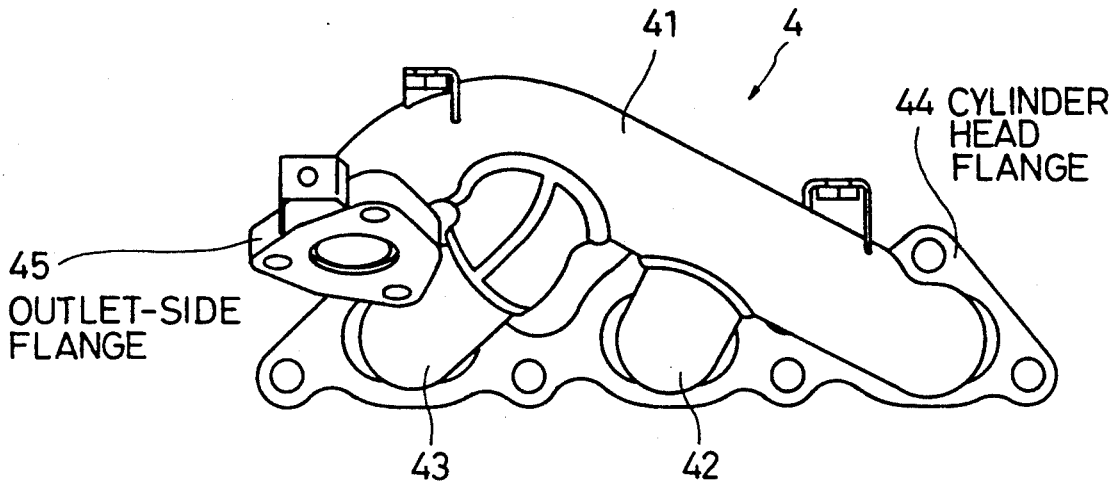
FIG. 2 is a front view of a front exhaust manifold.

FIG. 2 shows the front exhaust manifold 4 in detail. This front exhaust manifold 4 includes a first pipe 41, which has one end opening into an exhaust port of a first cylinder and the other end connected to the turbocharger 6 and extends in substantially the transverse direction of the vehicle along the front bank-side cylinder head of the engine 1 toward a fifth cylinder; third and fifth pipes 42 and 43, which are open at one end into exhaust ports of third and fifth cylinders, respectively, and connected at the other end to intermediate portions of the first pipe 41 by welding for communication therewith; a cylinder head flange 44 welded to the exhaust port-side ends of the pipes 41, 42 and 43; and an outlet-side flange 45 welded to the turbocharger-side end of the first pipe 41.

The pipes 41, 42 and 43 each includes a stainless steel pipe, preferably, a ferritic stainless steel pipe, having a wall thickness of about 2.5 mm. The most preferable stainless steel is SUS430LX. Table 1 below shows the comparison between various stainless steel pipes as to formability, weldability, high-temperature strength, and oxidation resistance, based on SUS430LX used as a criterion. The formability was evaluated in terms of bendability. In the table, symbols ◎, ○, and Δ represent superiority, equivalence, and inferiority to SUS430LX, respectively. Table 1 also shows the properties of spheroidal graphite cast iron FCD50HS suitably used for the rear exhaust manifold 5, for the sake of comparison. The chemical compositions of the respective steels are summarized in Table 2.

TABLE 1

| Steels | Formability | Weldability | High-temperature strength: Fatigue | Thermal Fataigue | Oxidation Resistance |
|---|---|---|---|---|---|
| AISI409 | ○ | ○ | Δ | Δ | Δ |
| SUS410L | ○ | ○ | Δ | Δ | Δ |
| SUS430 | Δ | Δ | Δ | ○ | ○ |
| SUS430LX | ○ | ○ | ○ | ○ | ○ |
| SUS304 | ○ | ○ | ◎ | Δ | Δ |
| FCD50HS | — | — | Δ | Δ | Δ |

TABLE 2

| Steels | C | Si | Mn | P | S | Ni | Cr | Nb | Other Elements | Fe |
|---|---|---|---|---|---|---|---|---|---|---|
| AISI409 | ≦0.08 | ≦1.00 | ≦1.00 | ≦0.045 | ≦0.045 | ≦0.50 | 10.5~11.75 | — | Ti 6 × C~0.75 | bal. |
| SUS410L | ≦0.03 | ≦1.00 | ≦1.00 | ≦0.04 | ≦0.03 | (≦0.6) | 11.0~13.5 | — | — | bal. |
| SUS430 (AISI430) | ≦0.12 | ≦0.75 | ≦1.00 | ≦0.04 | ≦0.03 | (≦0.6) | 16.0~18.0 | — | — | bal. |
| SUS430LX | ≦0.03 | ≦1.00 | ≦1.00 | ≦0.04 | ≦0.03 | (≦0.6) | 17.0~21.0 | 0.3~0.6 | Cu or Mo 0.3~0.8 | bal. |
| SUS304 | ≦0.08 | ≦1.00 | ≦2.00 | ≦0.045 | ≦0.03 | 8.00~10.50 | 18.0~20.0 | — | — | bal. |
| FCD50HS | 3.3~3.8 | 3.4~3.8 | ≦0.60 | ≦1.00 | ≦0.015 | ≦1.0 | — | — | Mo 0.4~0.6 Mg ≧0.025 | bal. |

For the outlet flange 45 of the front exhaust manifold 4, stainless steel, preferably SUS41OL, is used, because of its creep strength, oxidation resistance, and material cost. The cylinder head-side flange 44 is in contact with the water-cooled cylinder head and is cooled thereby, and therefore, the temperature thereof is low during operation of the engine. Thus, it is not necessary to use stainless steel for the flange 44, and an ordinary structural carbon steel, e.g., JIS SS41, may be used.

The rear exhaust manifold 5 for the rear bank 3 is made of cast iron, e.g., by casting spheroidal graphite cast iron FCD50HS. The ports of the exhaust manifold 5 have a wall thickness of, e.g., 4 mm or thereabouts.

Since the engine 1 is mounted to a vehicle body as close to the center thereof as possible, as mentioned earlier, the restriction on the space for the front exhaust manifold 4 of the front bank 2 is relatively loose. Moreover, the front exhaust manifold 4 is cooled by wind during the running of the vehicle. Accordingly, the heat-resisting strength of the front exhaust manifold 4 may be relatively low, and thin stainless steel pipes are used to reduce weight and heat capacity.

On the other hand, the space for the rear exhaust manifold 5 of the rear bank 3 is limited, as compared with the front exhaust manifold 4 for the front bank 2, and the rear exhaust manifold 5 is only slightly cooled by wind while the vehicle is running, because the rear exhaust manifold 5 is located at a rear side of the engine 1. Accordingly, the temperature condition must be more stringent than for the front exhaust manifold 4 of the front bank 2, while the heat capacity, even if large, does not greatly influence upon the reduction of the activation time of the main catalytic converter 13 at the start of the engine since the rear exhaust manifold 5 is located close to the main catalytic converter 13. Therefore, cast iron is used to increase the heat-resisting strength. Since the rear exhaust manifold 5 is produced by casting iron, its shape, thickness, etc., can be set freely in accordance with the requirements and the manifold 5 can be made compact. Thus, the wall thicknesses of the ports and other portions that require high heat-resisting strength can be easily made larger than those of the other portions, whereby a sufficient heat-resisting strength is obtained.

Figure 3:
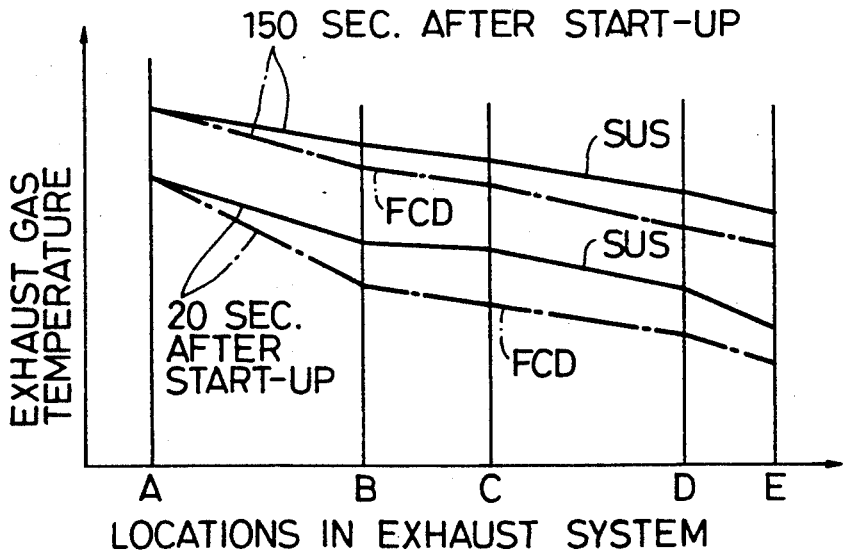
FIG. 3 is a graph showing changes in exhaust gas temperature at various parts of exhaust systems which are respectively equipped with a front exhaust manifold of stainless steel (SUS) and a front exhaust manifold of carbon steel (FCD)

FIG. 3 shows changes in temperature at various parts A–E (see FIG. 1) of the exhaust system using the front exhaust manifold 4 of stainless steel according to one embodiment this invention. In FIG. 3 the one-dot-chain lines indicate the temperature changes observed with the front exhaust manifold 4 made of cast iron. In either case, temperature changes at the various parts were measured upon the lapse of predetermined periods after engine start-up while the engine 1 was subjected to a bench test in an exhaust gas test running mode (LA4 mode). With regard to the exhaust gas temperature at the inlet of the catalytic converter upon the lapse of 20 seconds after the engine start, the exhaust gas temperature of the exhaust system using the front exhaust manifold 4 made of stainless steel (SUS) is significantly higher than that of the exhaust system using the front exhaust manifold 4 made of cast iron (FCD), and a significant reduction in the heat capacity of the manifold is apparent.

Figure 4:
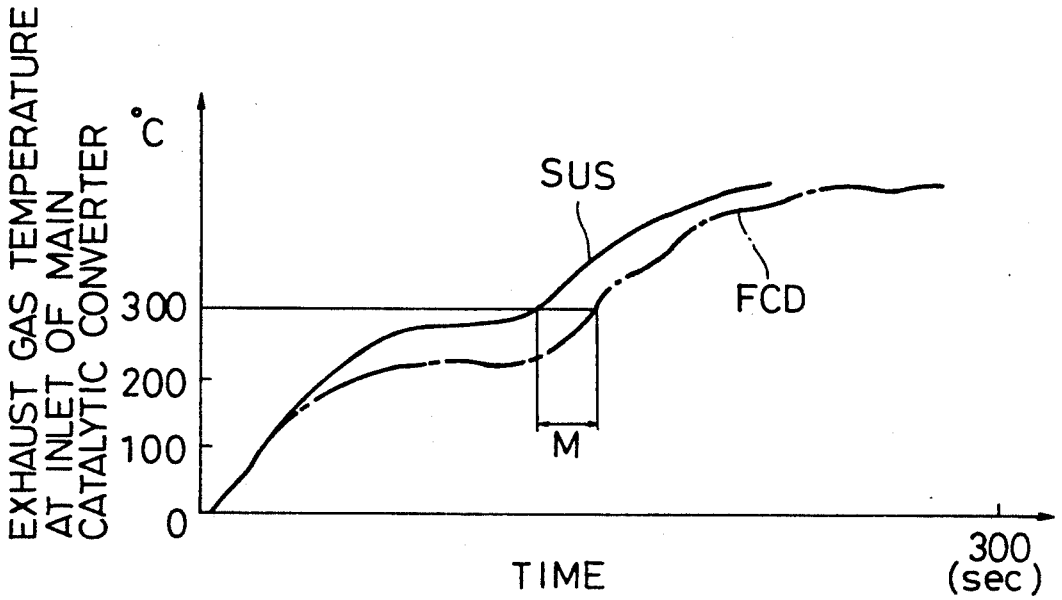
FIG. 4 is a graph showing time-based changes in exhaust gas temperature at inlets of main catalytic converters of engines which are respectively equipped with an exhaust system using a front exhaust manifold of stainless steel (SUS) and an exhaust system using a front exhaust manifold of carbon steel (FCD)
Figure 5:
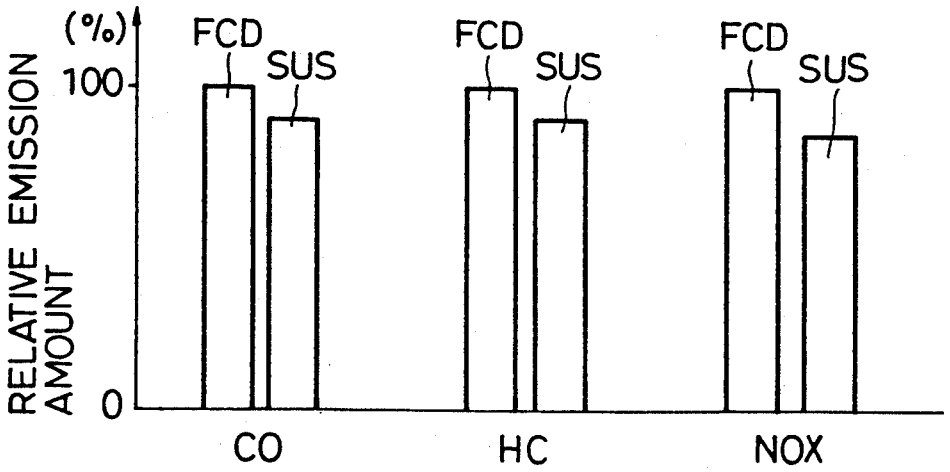
FIG. 5 is a graph showing relative emission characteristics of exhaust systems which are respectively equipped with a front exhaust manifold of stainless steel (SUS) and a front exhaust manifold of carbon steel (FCD).

FIG. 4 shows time-based changes of the exhaust gas temperature at the inlet D of the main catalytic converter 13 when the test was conducted in the aforementioned exhaust gas test running mode (LA4 mode). The time required for the catalyst activation in the exhaust system using the front exhaust manifold 4 made of stainless steel, i.e., the time required for the inlet temperature of the catalytic converter to reach 300° C., was shorter than that spent in the case of the exhaust system using the front exhaust manifold 4 made of cast iron by M seconds (about 12% of the time required for the inlet temperature of the catalytic converter to reach 300° C. when using the front exhaust manifold 4 made of cast iron). As the result of the reduction in the catalyst activation time, the amounts of toxic ingredients (CO, HC, NOx) in the exhaust gas could be reduced, as shown in FIG. 5. Namely, based on the reference emission amounts (100%) wherein the front exhaust manifold 4 made of cast iron was used, the amounts of carbon monoxide (CO), hydrocarbon (HC), and oxides of nitrogen (NOx) were all reduced when the front exhaust manifold 4 of stainless steel (SUS) was used, and thus, the exhaust gas could be effectively purified.

As described above, stainless steel pipes are used for the front exhaust manifold 4 of the front bank of a transverse V-type engine, and cast iron is used for the rear exhaust manifold 5 of the rear bank, whereby the front exhaust manifold of the front bank is sufficiently heat resistant and lightweight and the exhaust gas can be effectively purified as shown in FIG. 5. Further, making the rear exhaust manifold 5 of cast iron permits a reduction of size and manufacturing cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust manifold system for a transverse V-type engine in which an engine output shaft extends in the same direction as a transverse direction of an automotive vehicle and which includes front and rear banks, each having a plurality of cylinders, and an exhaust pipe, comprising:

a front exhaust manifold for conducting an exhaust gas discharged from the cylinders of the front bank to the exhaust pipe; and a rear exhaust manifold for conducting an exhaust gas discharged from the cylinders of the rear bank to the exhaust pipe;

the front exhaust manifold being produced by welding stainless steel pipes, and the rear exhaust manifold being produced of cast iron.

2. An exhaust manifold system according to claim 1, wherein the front exhaust manifold comprises a front flange made of carbon steel at which the front exhaust manifold is attached to the front bank.

3. An exhaust manifold system according to claim 1, wherein the pipes for producing the front exhaust manifold comprises stainless steel SUS430LX.

4. An exhaust manifold system according to claim 1, wherein the front exhaust manifold comprises an outlet flange at one end thereof close to the exhaust pipe, the outlet flange being made of stainless steel SUS410L.

* * * * *